US008237576B2

(12) United States Patent
Wander

(10) Patent No.: US 8,237,576 B2
(45) Date of Patent: Aug. 7, 2012

(54) MANHOLE SECURITY SYSTEM

(75) Inventor: Lloyd J. Wander, Venice, FL (US)

(73) Assignee: Utility Sealing Systems, Inc., Venice, FL (US)

( * ) Notice: Subject to any disclaimer, the term of this patent is extended or adjusted under 35 U.S.C. 154(b) by 0 days.

(21) Appl. No.: 12/177,240

(22) Filed: Jul. 22, 2008

(65) Prior Publication Data

US 2010/0019912 A1 Jan. 28, 2010

(51) Int. Cl.
*G08B 17/10* (2006.01)

(52) U.S. Cl. ..... 340/632; 340/870.16

(58) Field of Classification Search ..... 340/632, 340/603

See application file for complete search history.

(56) References Cited

U.S. PATENT DOCUMENTS

| | | | | |
|---|---|---|---|---|
| 5,628,152 | A | 5/1997 | Bowman | |
| 6,007,270 | A | 12/1999 | Bowman | |
| 7,002,481 | B1 * | 2/2006 | Crane et al. | 340/618 |
| 2007/0159326 | A1 * | 7/2007 | Quist et al. | 340/539.26 |

FOREIGN PATENT DOCUMENTS

| | | |
|---|---|---|
| JP | 6158676 | 6/1994 |
| JP | 2001003380 | 1/2001 |
| WO | WO-2007/100191 A1 | 9/2007 |
| WO | WO2007/100191 A1 | 9/2007 |

* cited by examiner

*Primary Examiner* — Brian Zimmerman
*Assistant Examiner* — Sara Samson
(74) *Attorney, Agent, or Firm* — Gifford, Krass, Sprinkle, Anderson & Citkowski, P.C.

(57) ABSTRACT

A manhole security system includes a barrier and an alarm. The barrier fits within a manhole opening and under a manhole cover. The barrier is also formed to substantially close the manhole opening to block access to the manhole if the cover is removed, and includes a basin to collect fluids that may otherwise drain into the manhole. The alarm of the system is positioned on the barrier and includes a monitoring device operable to directly or indirectly monitor the position of the manhole cover and/or to detect a volatile gas in the manhole. Upon the removal of a manhole cover and/or upon the detection of a volatile gas within the manhole, the alarm emits an audible alert and/or transmit a signal to a remote station indicating that the manhole cover has been removed an/or the presence of a volatile gas in the manhole.

5 Claims, 2 Drawing Sheets

MANHOLE SECURITY SYSTEM

BACKGROUND OF THE INVENTION

1. Field of the Invention

Disclosed herein is a security system for a manhole. The system includes an alarm to indicate that the manhole cover has been removed as well as sensors and alerting means to remotely indicate the presence of a volatile gas within the sewer system in the vicinity of the manhole.

2. Reference to Related Art

Modern cities operate, in part, using a maze of subterranean utility lines, such as water, steam and sewer lines, and underground conduits that may house and protect gas lines, power transmission lines, and a variety of electronic equipment. However, despite the importance of these utilities, the only device that typically stands between a person gaining access to a subterranean line or conduit is a simple iron or steel manhole cover. These manhole covers are quite heavy and, accordingly, might naturally inhibit some attempts at their removal. The actual removal of a cover, however, does not require significant technical expertise. Indeed, at present, it has become common for covers to be stolen simply so the thief may sell the cover for its scrap metal value. Furthermore, while modern covers may create a tight fit around the manhole opening, a cover alone may not create a seal sufficient to prevent fluid from leaking past the cover and into the lines and conduits.

Further the presence of a volatile gas within the manhole can be a serious problem and can lead to explosions causing property destruction and even death.

Accordingly, it would be advantageous to have a manhole security system that may provide an alert following the removal of a manhole cover and/or the presence of a volatile gas within the manhole.

SUMMARY OF THE INVENTION

A manhole security system includes a barrier and an alarm. The barrier is dimensioned to fit within a manhole opening and under a manhole cover. An alarm system is positioned beneath the barrier and includes monitor devices in the form of sensors including a motion detector to provide a signal if the manhole cover is moved. The sensors include a gas sniffing computer chips operable to detect the presence of volatile gases in the sewer system in the vicinity of the manhole. Upon the removal of a manhole cover or upon sensing the existence of a volatile gas within the manhole, the alarm may emit an audible alert and/or transmit a signal to a remote station to indicate remotely that either that a particular manhole cover has been removed or that a volatile gas is within that manhole.

BRIEF DESCRIPTION OF THE DRAWINGS

Reference will now be had to the attached drawings wherein like reference numerals refer to like parts throughout and wherein.

DETAILED DESCRIPTION OF A PREFERRED EMBODIMENT

Figure 1:
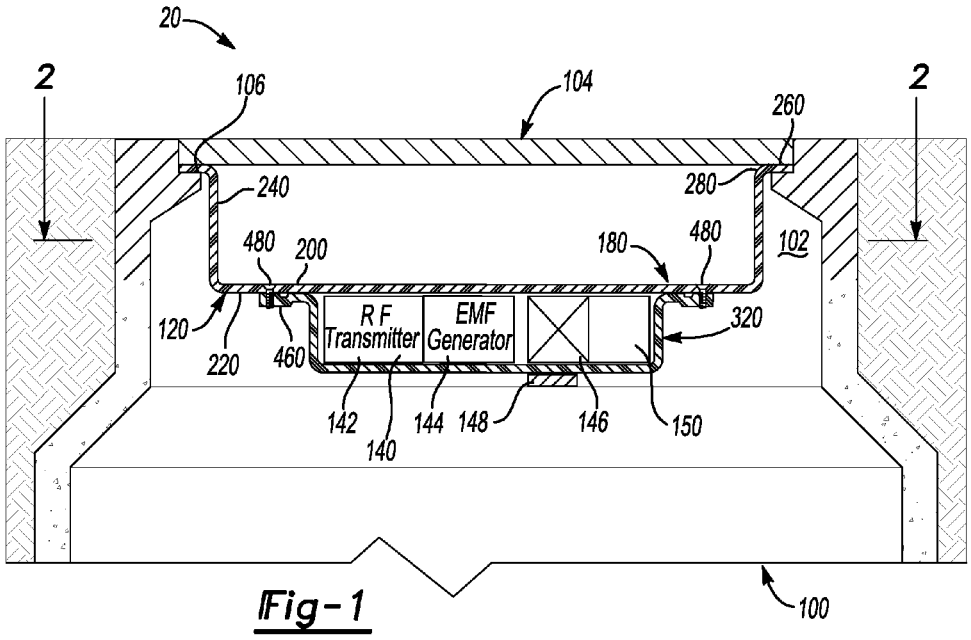
FIG. 1 is a cross sectional view of a manhole security system in position in a manhole.
Figure 2:
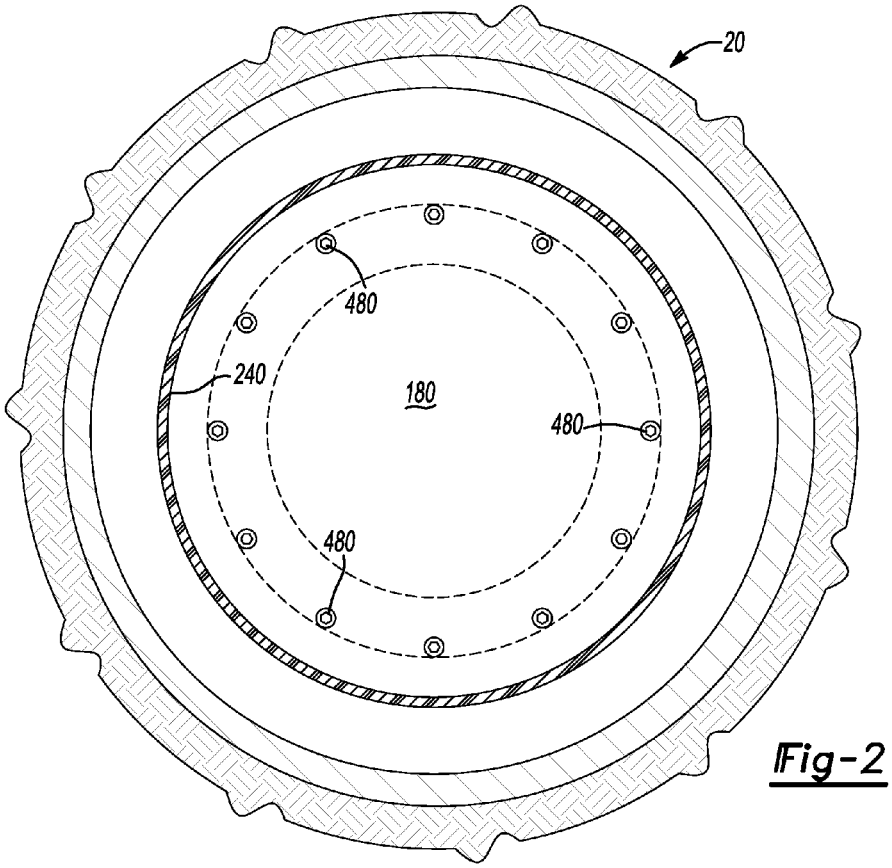
FIG. 2 is a cross sectional view of the manhole security system of FIG. 1 and taken substantially at line 2-2 of FIG. 1.

Referring now to FIGS. 1 and 2, a manhole security system 20 includes a barrier 120 and an alarm system 140. The barrier 120 is dimensioned to fit within a manhole 100, specifically the manhole opening 102, and under a manhole cover 104. The barrier 120 may also be formed to substantially close off the manhole opening 102 to block access to the manhole 100 if the cover 104 is removed. The alarm system 140 is mounted to the underside of the barrier 120 and includes a monitoring system 320 including sensors 148 operable to monitor the position of the manhole cover 104 as well as the presence of volatile gases in the manhole 100. Upon the removal of a manhole cover 104, and/or the presence of volatile gases in manhole the alarm system 140 will be actuated by the sensor 148 to emit an audible alert and/or transmit a signal to a remote station 500 (FIG. 3) indicating that the manhole cover 104 has been removed and/or that volatile gases are in the sewer system in the vicinity of the manhole 100.

Still referring to FIG. 1, the barrier 120 of the system 20 may be molded using known molding techniques and materials (such as commercially available polymer products). The barrier 120 preferably includes a base or floor 180, having a top surface 200 and a bottom surface 220, a sidewall 240 that extends upwardly from (and around the perimeter of) the top surface 200 of the floor 180, and a rim or lip 260 that extends generally horizontally outward from an end 280 of the sidewall 240 opposite the floor 180.

The rim 260 of the barrier 120 may rest on, be secured to, or otherwise engage a flange 106 or like structure defined in the opening 102 of the manhole 100 to support the cover 104. As such, it will be appreciated that the barrier 120 may be supported in the opening 102 of the manhole 100 and take on the general shape of a recessed dish or basin that extends across the entire (or a substantial portion of) the opening 102. In such a configuration, the barrier 120 may function to block access to the manhole 100 if the cover 104 is removed and also collect any fluid that may drain into the manhole 100. As shown in FIG. 1, this arrangement of the barrier 120 may also permit the manhole cover 104 (when placed in position in the opening) to rest on top of the rim 260 of the barrier 120.

Attached to a bottom surface 220 of the floor 180 of the barrier 120 is a housing 320, molded using known materials and techniques. Alternatively, the housing 320 may be formed integral to the barrier 120 or may be attached to the top surface 200 of the floor 180. The housing 320 contains the components of the alarm system 140, including the radio frequency (RF) transmitter 142, an electromagnetic field (EMF) generator 144 and a battery 146. Further, the housing 320 may be sealed by a gasket 460. The housing 320 may be secured to the barrier 120 by the use of threaded fasteners 480 or the like.

The EMF generator 144 affords the establishment of an electromagnetic field in relation to the manhole cover 104 such that if and/or when the manhole cover 104 is removed from the manhole opening 102 the electromagnetic field is altered. Upon alteration of the electromagnetic field by a predetermined amount, the RF transmitter 142 can transmit an alarm signal to a distant receiver and thereby notify another that the manhole cover 104 has been removed. An audio alarm 150 can also be energized upon the alteration of the electromagnetic field. It is appreciated that the battery 146 affords for electrical power to the RF transmitter 142 the EMF generator 144, and the audible alarm 150 and upon the battery 146 reaching a predetermined low battery power level, the RF transmitter 142 can transmit a low power signal to a distant receiver.

Still referring to FIG. 1 the manhole security system 20 includes a volatile gas sensing system that affords for the detection of a flammable gas or gases in the manhole. The system preferably includes a number of "sniffer" or volatile gas chips 148. A sniffer chip is well known in the art and is defined as a computer chip that affords for the detection of a predetermined gas. The University of Florida has developed a number of sniffer or volatile gas chips sensitive to volatile gases such as benzene, propane, methane, natural gas and the like.

It is appreciated that upon detection of a predetermined level of a gas to be detected by the sniffer chips 148, the RF transmitter 142 (FIG. 3) transmits a gas detection signal to a distant receiver and/or an audio alarm signal can be energized. A control circuit (not shown) can afford for communication between the RF transmitter 142, the EMF generator 144, the battery 146 and the sniffer chips 148 of the gas detecting system.

Figure 3:
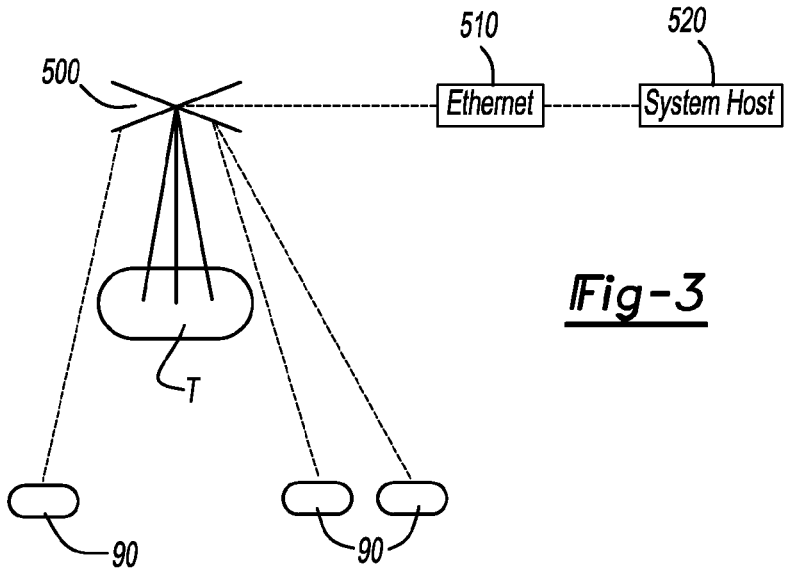
FIG. 3 is a schematic representation of an embodiment of the present invention in use with the Internet.

Turning now to FIG. 3, an embodiment of the present invention is shown wherein the manhole security system including the alarm system 148 is in communication with a remote data collection device 500 that is further in communication with an ethernet 510 and a system host 520. A preferred remote collection system is presently sold under the NETCOLLECTOR trademark although other systems could be used as well. The manhole security system 20 can be part of a manhole cover 104 as described above, with each including a RF transmitter 142 operable to transmit a signal to the remote data collection device 500 from any of a number of manholes. In some instances, the remote data collection device 500 can include a wireless, spread spectrum, frequency hopping, half duplex, ISM compliant remotely deployable data collection/transmission system. In addition, the system can use a software defined radio technology which is known to those skilled in the art. The remote data collection device 500 can connect directly to the Internet and in some instances as illustrated in FIG. 3 can do so through the use of an Ethernet 510.

The remote data collection device 500 can be assembled or located on a cell phone tower T, the tower T being a distance spaced apart from the manhole security system 90. In some instances, the tower T can be spaced apart up to 1,000 feet from the manhole security system 90. In other instances, the tower T with the remote data collection device 500 thereon can be spaced greater than 1,000 feet from the manhole security system 90. It is appreciated that the remote data collection device 500 on the tower T can be elevated above the ground, for example 15 feet. Wireless telephone towers could of course be used as towers for this purpose.

In operation, the EMF generator 144 establishes an electromagnetic field in relation to the manhole cover 104 and if or when the manhole cover 104 is removed from the manhole opening 102, the electromagnetic field is altered. Upon the alteration of the electromagnetic field by a predetermined amount, the RF transmitter 142 transmits an alarm signal to the remote data collection device 500.

Similarly if a volatile gas is sensed in the manhole 100 by the alarm system 148 a signal is sent by the RF transmitter 142 to the remote data collection device 500.

Thereafter, once the system host 520 is logged onto the Internet, the communication linkage is established between the system host 520 and the remote data collection device 500. At this time, the alarm signal transmitted by the RF transmitter 142 to the remote data collection device 500 is communicated to the system host 520, thereby alerting necessary personnel that the manhole cover 104 has been removed from the manhole opening 102 or that a volatile gas has been detected in the manhole 100. In this manner, a manhole security system is provided wherein the removal of a manhole cover and or the presence of a dangerous gas in the manhole can be determined from a remote location.

Figure 4:
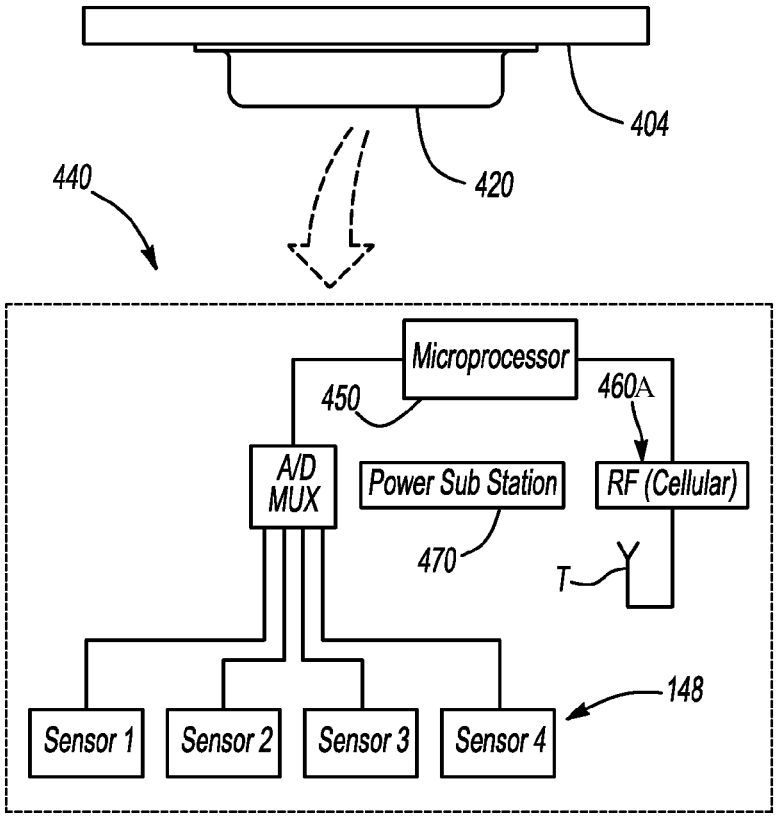
FIG. 4 is a diagrammatic representation of another embodiment of the present invention.

FIG. 4 is a diagrammatic representation of a modification of the manhole security system of the present invention. The manhole cover is shown diagrammatically at 404 as is the housing 420. The alarm system 440 that is intended to fit within the housing 420 includes sensors 148 designated as on the drawing Sensor 1, Sensor 2, Sensor 3, Sensor 4. Sensors 1, 2, and 3 detect volatile gases and when dangerous gases are detected as being within the manhole the information is transmitted to a control microprocessor 450. Sensor 4 is a motion detector and sends information to the control circuit if it detects motion of the manhole cover 404. The information is then transmitted to a remote location by way of RF cellular network 460A and a cellular tower T. A power supply is also included to provide power for the alarm system.

Having thus described my invention, various other improvements will become known to those of skill in the art that do not depart from the spirit or scope of the present invention.

I claim:

1. In combination with a manhole and a removable manhole cover closing the manhole;

a barrier in the form of a dish removably mounted in said manhole below and separate from said cover and extending completely across said manhole separate from said manhole cover;

said barrier completely closing said manhole, an alarm system mounted to the underside of said barrier and operable to detect the presence of a volatile gas in the manhole and to produce an alarm when the presence of a volatile gas is detected in the manhole, said system comprising:

a sensor operable to monitor the presence of volatile gases in the manhole;

an alarm actuated by the sensor when volatile gases are detected in the manhole;

a station remote from the manhole; and said alarm system further comprising a transmitter actuated by said sensor to receive and transmit a signal to the remote station to indicate at a remote location that volatile gases are present in the manhole.

2. The combination as defined in claim 1 and in which said volatile gases are selected from the group consisting of benzene, propane, methane, and natural gas.

3. The combination as defined in claim 1 and in which said manhole is normally closed by the manhole cover and said alarm system further comprising;

a motion sensor positioned to sense movement of the manhole cover;

said alarm being actuated upon said motion sensor sensing movement of the manhole cover.

4. The combination as defined in claim 1 and in which said manhole is normally closed by a manhole cover and said system further comprising;

attaching means mounting said sensor and said alarm to said barrier and within said manhole.

5. The combination as defined in claim 1 and in which said manhole is provided with a ledge disposed in said manhole below said manhole cover and said barrier having an outer peripheral portion resting on said ledge to removably mount said barrier and said alarm system within said manhole at a position spaced from said manhole cover.

* * * * *

UNITED STATES PATENT AND TRADEMARK OFFICE

CERTIFICATE OF CORRECTION

PATENT NO. : 8,237,576 B2
APPLICATION NO. : 12/177240
DATED : August 7, 2012
INVENTOR(S) : Lloyd J. Wander It is certified that error appears in the above-identified patent and that said Letters Patent is hereby corrected as shown below:

On the Title Page:

Abstract Item (57):

Line 12, Delete “transmit”, Insert --transmits--

Line 14, Delete “an/or”, Insert --and/or--

In the Specification:

At column 1, line number 46, Delete “a”

At column 1, line number 52, After either, Delete “that”

At column 2, line number 15, After gases in, Insert --the--

At column 2, line number 16, After manhole, Insert --,--

At column 2, line number 56, After 102, Insert --,--

At column 2, line number 63, After 142, Insert --,--

Signed and Sealed this
Twenty-third Day of June, 2015

Michelle K. Lee

Michelle K. Lee
*Director of the United States Patent and Trademark Office*